United States Patent [19]

Carlsson

[11] 3,955,550

[45] May 11, 1976

[54] FLYWHEEL MAGNETO IGNITION DEVICE WITH CAPACITOR-THYRISTOR IGNITION COMBINED WITH GENERATOR

[75] Inventor: Hans Thorsten Henrik Carlsson, Amal, Sweden

[73] Assignee: Aktiebolaget Svenska Elektromagneter, Sweden

[22] Filed: Aug. 13, 1974

[21] Appl. No.: 497,130

[52] U.S. Cl. ..... 123/149 D; 123/148 E; 123/149 R; 310/70 R; 310/153

[51] Int. Cl.[2] ..... F02P 3/06

[58] Field of Search ..... 123/149 R, 149 C, 149 D, 123/148 E; 310/153, 156, 70 R

[56] References Cited

UNITED STATES PATENTS

| | | | |
|---|---|---|---|
| 2,020,078 | 11/1935 | Nowosielski | 123/149 D |
| 3,641,377 | 2/1972 | Fujii | 310/153 |
| 3,673,490 | 6/1972 | Magrane | 123/140 D UX |
| 3,741,185 | 6/1973 | Swift et al. | 123/149 D X |
| 3,828,754 | 8/1974 | Carlsson | 123/149 R X |

*Primary Examiner*—Charles J. Myhre
*Assistant Examiner*—Tony Argenbright
*Attorney, Agent, or Firm*—Hill, Gross, Simpson, Van Santen, Steadman, Chiara & Simpson

[57] ABSTRACT

For an internal combustion engine, there is provided an electrical power generator system and an electronic ignition system both disposed under the flywheel casing. Permanent magnet means provide a rotating magnetic field for the generating coils of the generator system and the charging coils of the ignition system, there being a separate trigger magnet for creating a magnetic field for a trigger coil of the ignition system. A shielding plate of ferromagnetic material is fixedly disposed between the permanent magnet means and the trigger magnet to shield the trigger coil magnetically from the field of the permanent magnet means whereby it will respond only to the field from the weaker trigger magnet. Preferably, the shielding plate can be angularly adjusted and supports the trigger coil to enable adjustment of timing.

6 Claims, 5 Drawing Figures

FLYWHEEL MAGNETO IGNITION DEVICE WITH CAPACITOR-THYRISTOR IGNITION COMBINED WITH GENERATOR

BACKGROUND OF THE INVENTION

1. Field of the Invention

This invention refers to a device for a flywheel magneto with an electronic ignition system in combination with a generator.

2. Prior Art

It is a known fact that flywheel magnetos having an electronic ignition system in combination with a generator and a trigger release of the ignition pulse are, for the exact ignition function, extremely dependent on the magnetic field which causes the trigger pulse being as far as possible uninfluenced by the other magnetic fields in the system. With regard to the total output of the magneto, these fields must as a rule be made very strong, with the result that leakage fields can occur which influence the separately arranged magnetic field for the trigger coil. Since the load on the generator side varies as the power take-off from zero to maximum, the magnetic flux which creates the generator current will also vary considerably. It is these flux alterations which can, in combination with a varying speed for the flywheel magneto, adversely affect the trigger function to cause displacements in the spark position, among other things.

The only technical cure available with flywheel magnetos of the kind discussed is to provide an as effective magnetic screen as possible between the often strong magnetic fields of the generator part, and the relatively considerably weaker magnetic field or fields causing the trigger pulse. In another embodiment, the generator with associated permanent magnets is arranged inside the flywheel, in tandem with an armature having permanent magnets, mounted above the flywheel. The charging coil required for the ignition function, together with the trigger coil is arranged in connection with the armature. In this arrangement the flywheel, which is intended to be of ferromagnetic material, forms a screen between both the magnetic fields, extremely effectively preventing any mutual influence. The ignition side is completely separated from the generator side in that the armature mounted above the flywheel causes both the magnetic field required for the charging coil and the magnetic field which causes the trigger pulse.

In another embodiment, in order to reduce the total installation height of the magneto apparatus as much as possible, the trigger coil is arranged, possibly with accompanying electronic components, under the flywheel instead of above it. In such a case a special trigger magnet must be mounted on the inside of the wheel for coaction with the trigger coil. The trigger magnet is then placed on the inside of the cylindrical circumference of the flywheel, and will unavoidably lie side by side with the wreath of permanent magnets causing the rotating field for the generator part. In such arrangement, the trigger magnet lies very close to the permanent magnets of the generator side, and measures must unavoidably be taken to prevent flux influence between both magnetic systems.

SUMMARY OF THE INVENTION

According to the present invention a magnetic screening effect is provided for a flywheel magneto, arranged with electronic ignition in combination with a generator and with the generator portion as well as the ignition portion arranged inside the flywheel casing, by having a non-rotating screening plate of ferromagnetic material pivotally mounted about a central axis. The screening plate is so arranged between both the sections that it, at least in the secant or secants within which screening is necessary, provides a maximum protecting effect between the generator portion and the ignition portion without negatively affecting the output of the generator portion. The form and location of the screening plate is such that, with one or several projecting portions of its periphery, it projects in between the generator magnets and the trigger magnet or magnets in an area where the magnetic field would otherwise have interfered, due to leakage fluxes, with disturbances on the ignition side as a result.

The form of the screening plate also has the advantage that assembling the flywheel on the armature plate can be done without hindrance, as the projecting portions of the periphery of the screening plate leave a space of such a size that the trigger magnet or magnets can easily pass by the screening plate, when the flywheel is put in place on the engine shaft.

A further distinguishing feature is that the screening plate is pivotally mounted on the armature plate about the geometrical axis of the flywheel magneto, and that it is arranged to carry the trigger coil and alternatively the different components of the electronic ignition system as well.

The invention will now be more closely described in the following while referring to the accompanying drawings.

ON THE DRAWINGS

AS SHOWN ON THE DRAWINGS

Figure 1:
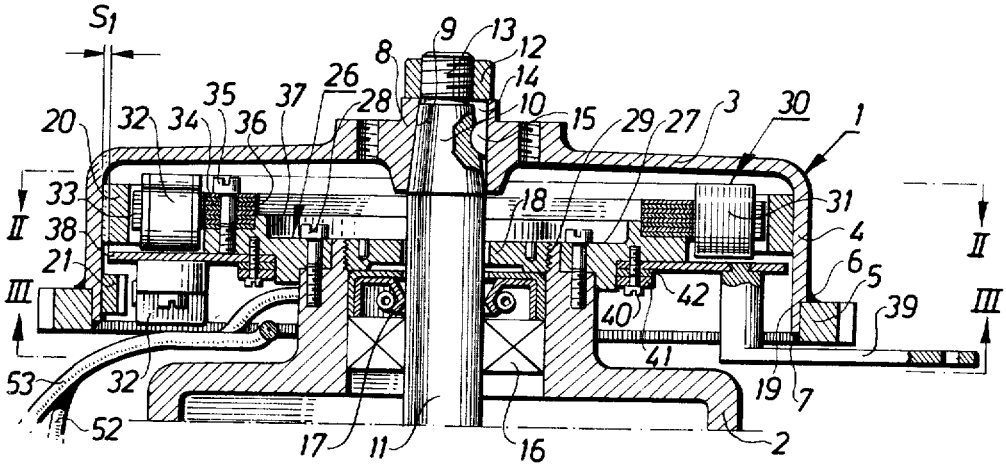
FIG. 1 shows in cross-section a flywheel magneto for electronic ignition in combination with a generator.
Figure 2:
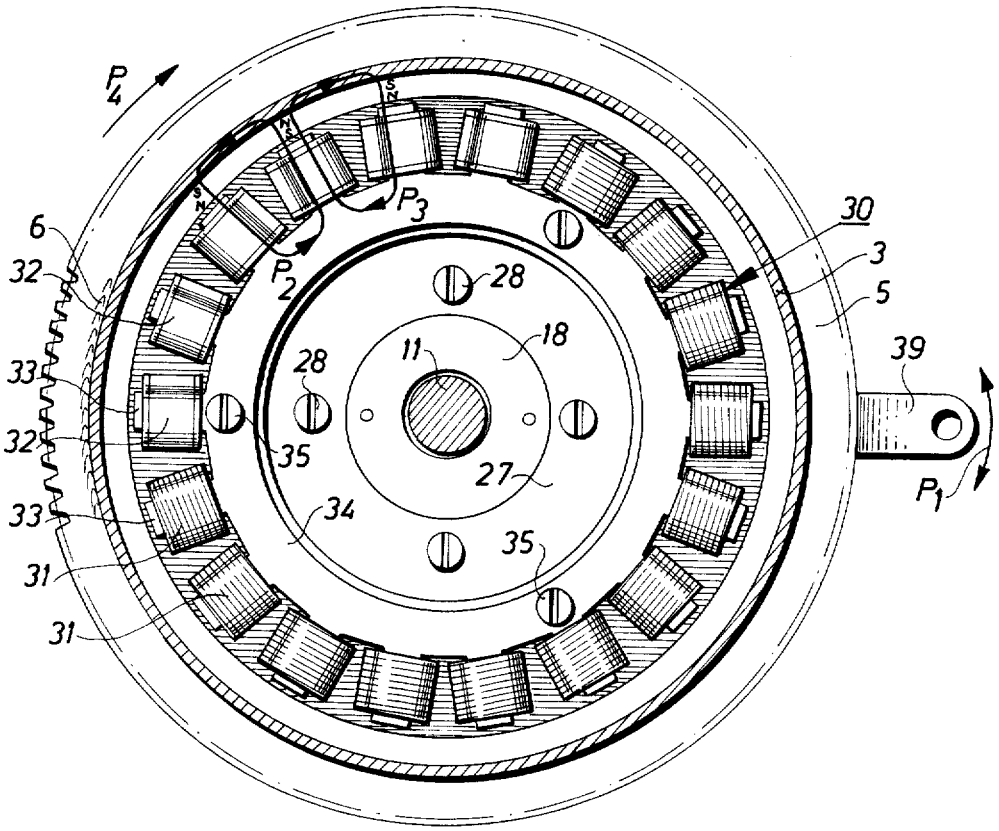
FIG. 2 shows a plan section along line II—II of FIG. 1.
Figure 3:
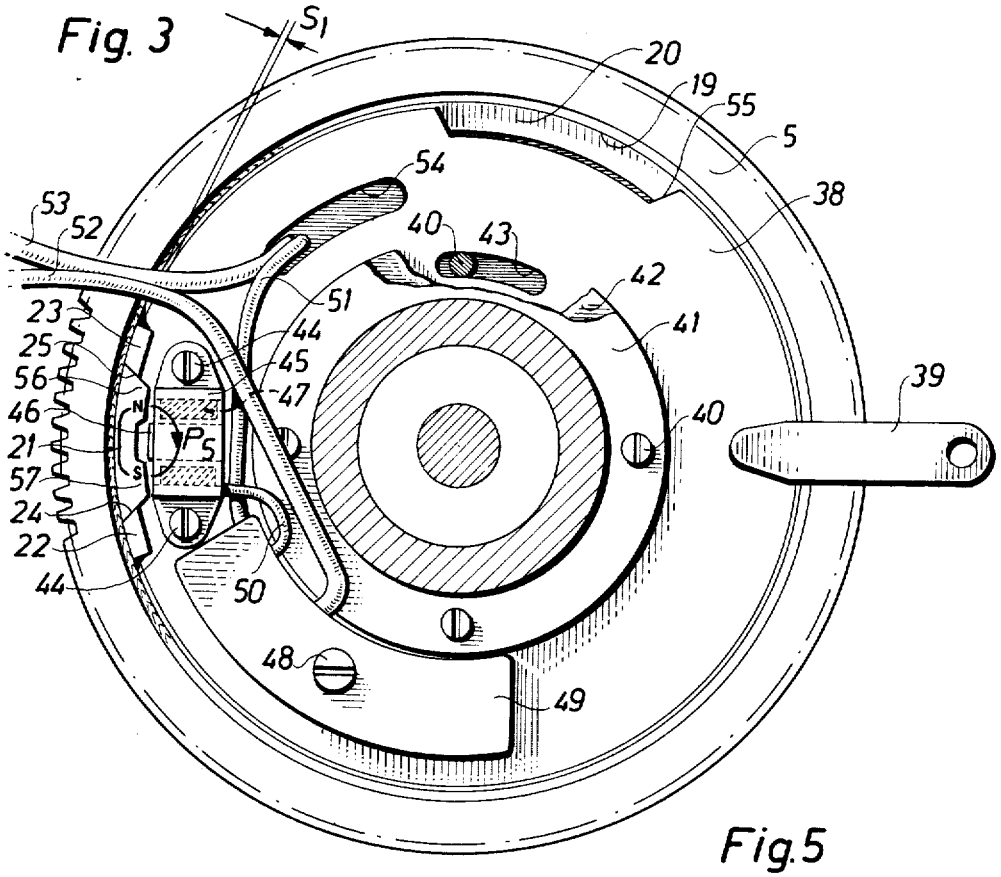
FIG. 3 shows a plan section along line III—III in FIG. 1.

The flywheel magneto according to FIGS. 1-3, generally designated by the numeral 1, is, as best seen in FIG. 1, arranged on a crank case 2 of an internal combustion engine not further shown. The flywheel magneto 1 comprises a casing 3 with a cylindrical portion 4, at the outer free edge of which there is a toothed rim or gear 5 attached by welds 6, 7. The toothed rim or gear 5 coacts with a starting motor, not shown, for electrically starting the internal combustion engine.

The center of the casing 3 is made with a hub portion 8 having an inner frusto-conical hole 9 fitting a corresponding frusto-conical seat 10 on the crank shaft end 11 of the internal combustion engine. When tightened, a nut 12 presses the hub portion 8 against the frusto-conical seat 10 via an outwardly threaded portion 13 of the crank shaft end 11. For further ensuring this connection, the hub portion 8 has a keyway 14, in which a key 15 is fitted.

The shaft end 11 is journalled in the crank case 2 by a roller bearing 16 outwardly sealed by a sealing ring 17. Both the bearing 16 and the sealing ring 17 are kept in place in the crank case 2 by a threaded bearing cover plate 18.

On an inner cylindrical surface 19 of the flywheel casing 3, two separate systems of permanent magnets are arranged at different levels, viz., uppermost in FIG. 1 an annular magnet 20 and lower down a separate trigger magnet 21. The annular magnet 20 suitably comprises a band of anisotropic magnetic material with a rectangular cross-section, plastically bound, and is preferably attached to the cylindrical surface 19 by pressing in and cementing.

The trigger magnet 21 is preferably made of an oxide material and is attached to the cylindrical surface 19 by two cheek plates 22, 23 FIG. 3, welded or screwed onto it, and having opposing oblique end surfaces 24, 25 between which the trigger magnet 21 is pressed in and fixed in position, e.g. by cementing. The flywheel casing 3 is of ferromagnetic material, preferably soft iron, being thus magnetically conducting and also weldable. The annular magnet 20 and the trigger magnet 21 are magnetized as described below.

Inside the flywheel casing 3 there is an armature plate, generally designated by the numeral 26 coacting with the annular magnet 20 and trigger magnet 21, and carrying the electrical as well as preferably the electronic components, which in coaction with the annular magnet 20 and the trigger magnet 21, respectively cause generating power for lighting, battery charging and the like, and ignition power via an electronic ignition system. The armature plate 26 comprises a base plate 27 of a non-magnetic material, e.g. aluminum, coaxially arranged in relation to the crank shaft end 11 and attached to the crank case 2 by attachment screws 28, a circular guiding rim 29 ensuring coaxial location. The upper side of the base plate 27 carries a coil system 30 having eighteen coils of two different types and operational tasks, i.e. twelve generator coils 31 for providing generating power, and six charging coils 32 for generating charging voltage to a capacitor in the electronic ignition system. The coils 31, 32, as shown in FIG. 2, are arranged in groups each on its pole leg 33 on an eighteen-pole annular coil core 34 of laminated transformer plate. The coil 34 is arranged concentrically with the flywheel casing 3 and is attached to the base plate 27 by screws 35, an inner cylindrical guiding surface 36 for the coil cores 34 and a guiding rail 37 on the base plate 27 ensuring concentric location. The coil core 34 is so arranged in height that the pole leg 33 is axially centered in the annular magnet 20.

The base plate 27 is provided on a lower side with a screening or shielding plate 38 of ferromagnetic material, e.g. iron. The screening plate 38 is a circular disc with recess 55, FIG. 3, the function of which is described below. The outer diameter of the screening plate 38 is so disposed that with a clearance $S_1$, it extends to the inner cylindrical surface 19 of the flywheel casing 3. The screening plate 38 is further pivotally mounted on the base plate 27, although maintained under friction so that it can only be turned under the influence of an outside force. The outside force can be applied to the screening plate 38 via an adjusting lever 39 attached to it, the position of which is adjustable according to the double arrow $P_1$ in FIG. 2. Holding of the screening plate 38 against the base plate 37 under friction is accomplished by screws 40, a pressure ring 41 and a friction ring 42. The screws 40 are threaded into the base plate 37 and go through circular holes in the tension ring 41 and the friction ring 42 but through elongated holes 43, FIG. 3, in the screening plate 38. By means of the elongated holes 43, the screening plate can be moved in the directions of the double arrow $P_1$, FIG. 2, within an angular range of approximately ± 15°.

A trigger coil 45 having a coil core 46 and a coil winding 47 is attached by a pair of screws 44 to the lower side of screening plate 38. The trigger coil 45 is potted in synthetic resin and thereby well protected from external abuse. On the lower side of the screening plate 38, a block 49 is also attached by a screw 48, the block containing the necessary electronic components, potted in synthetic resin, for the ignition system, explained below. Two leads 50 and 51 connect the electronic components in the block 49 with the coil winding 47 and the charging coils 32 on the coil core 34 respectively, FIG. 2. There is further a lead 52 from the block 49, connecting to an ignition coil arranged outside the flywheel magneto 1, there being also an outgoing lead 53 connecting the generator coils 31 with terminals for different uses (not shown) e.g. lighting, battery charging, etc. The leads 51, 53 pass as shown in FIG. 3 through the screening plate 38. To enable the previously mentioned angular adjustment or pivoting of the screening plate 38 by approximately ± 15°, a sufficiently long elongated hole 54, FIG. 3, is provided in the screening plate 38 for the passage of the leads 51, 53.

The screening plate 38, as shown in FIG. 1, is so mounted in height that it lies between the annular magnet 20 and the trigger magnet 21. As previously mentioned, its outer diameter is sufficiently large for the clearance $S_1$ to be available between the inner circular surface 19 and the outer periphery of the screening plate 38. In order that the flywheel casing 3 with its dimensions can be brought into the position of assembly according to FIG. 1, the periphery of the screening plate 38 is broken by the previously mentioned recess 55, which is arranged at a distance from the trigger coil 45. In the example shown, the recess 55 is sufficiently large for the trigger magnet 21 with cheek plates 22, 23 to pass easily through when the flywheel casing 3 is mounted on the conical seating 10. generator 51, 53 ±

The annular magnet 20 comprises anisotropic magnetic material. The direction of orientation is transverse, i.e. radial in relation to the flywheel casing 3. In the present example, the annular magnet 20 is magnetized with eighteen poles having a pitch corresponding to the angular pitch of the pole legs 33 of the annular coil core 34. As shown in FIG. 2, the poles lie alternately N and S, which signifies that a magnetc field according to arrows $P_2$, $P_3$, FIG. 2, occurs for each pole pair. When the flywheel casing 3 rotates, according to arrow $P_4$ for example, its magnetic fields create a generator voltage in the coils 31 and a charging voltage in the coils 32. The generator coils 31 can all be coupled in series or coupled parallel/series in groups, while on the other hand the charging coils 32 are all suitably coupled in series, taking into account the required comparatively high charging voltage for the capacitor.

The trigger magnet 21, FIGS. 1 and 3, is an ordinary magnet, e.g. ceramic, which does not need to be anisotropic. It is made with two pole legs 56, 57 having inner edges spaced apart by a distance approximately corresponding to the width of coil core 46 of the trigger coil 45. The trigger magnet 21 is magnetized longitudinally and with pole designations N, S, in FIG. 3, causes a magnetic field according to the arrow $P_5$. Since in practice only a low trigger voltage is required from the coil winding 47, the magnetic field according to arrows $P_5$ can also be low.

Figure 4:
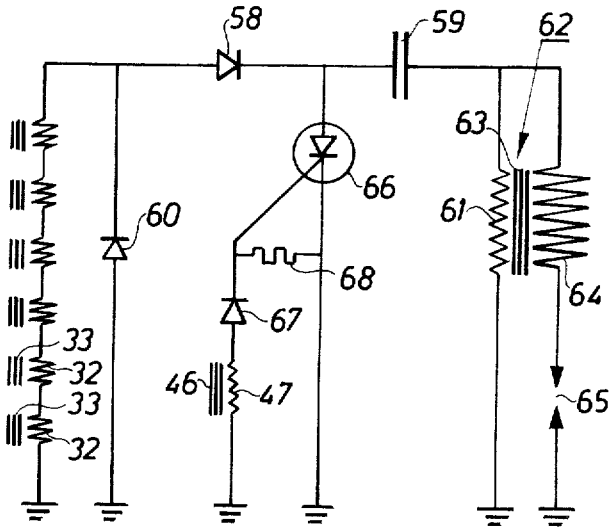
FIG 4 shows a circuit diagram for the ignition system of the flywheel magneto according to FIGS. 1-3.
Figure 5:
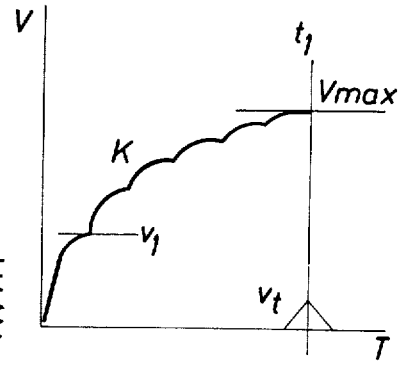
FIG. 5 is a diagram showing charging voltage to a capacitor connected in the circuit diagram according to FIG. 4.

In order to understand the significance of screening plate 38 according to the invention correctly, a short description is given here of the operation of the electronic ignition system, while referring to FIGS. 4 and 5, using the same designations for appropriate parts as have been previously used. In the first place, the generator side, i.e. the generator coils 31 with the associated sector of the annular coil core 34 do not in any way coact with the electronic ignition system, but on the other hand the charging poles 32 provide it with the current required for the ignition system function. The latter situation is clearly apparent from the circuit diagram of FIG. 4, which shows that the current from the series connected charging coils 32 via a first diode 58 is led to a capacitor 59. Each whole passage of a pair of poles on the annular magnet 20, FIG. 2, creates a positive and a negative half wave from the charging coils 32. Only the positive half wave is conducted to the capacitor 59 through the first diode 58, while the negative half wave is eliminated by a second diode 60 which is coupled in parallel over the charging coils 32, FIG. 4.

When the capacitor 59 is charged to a predetermined voltage by a series of positive half waves, a discharge takes place via a primary winding 61 to an ignition coil 62 having an iron core 63 and a secondary winding 64, so that a spark occurs in a spark plug 65. Discharging the capacitor 59 through the primary winding 61 is effected by a thyristor 66 closing the current path at a timing pulse from the trigger coil winding 47. In series with the latter and the thyristor 66 there is a third diode 67 which only passes the positive half wave from the trigger coil winding 47. As shown in FIG. 4, in the thyristor circuit there is also connected a resistor 68, for suiting the positive timing pulse voltage level to a predetermined value.

In FIG. 5 is shown a diagram for a charging curve K for the capacitor 59, voltage V being given along the Y-axis, and time T along the X-axis. A first charging pulse brings the voltage up to a value of $v_1$, whereafter following voltage pulses in successively falling steps increase the capacitor voltage to a final value of $V_{max}$. This value has been reached at a time $t_1$, whereon a trigger pulse $v_t$ actuates the thyristor 66 and thus enables a discharge of the capacitor with a resulting spark in spark plug 65.

The spark in the spark plug 65, which is to take place at exactly the right sparking position for the internal combustion engine, requires perfect timing for the trigger pulse $v_t$ from the trigger coil winding 47. In turn this requires, apart from the screening plate 38 and therewith the trigger coil 45 being in the right position due to the adjusting lever 39, that the magnetic field, according to arrow $P_5$, from the trigger magnet 21, can be developed without being disturbed both with regard to magnitude and direction. The trigger magnet field is comparatively weak and can very easily be subjected to influence from the considerably stronger field from the annular magnet 20.

The screening plate 38 is arranged for circumventing precisely such an influence. As it is of ferromagnetic material, it will directly absorb the leakage fields which can emanate from the annular magnet 20 and effectively prevent these from spreading to the trigger magnet 21. Contributing in a high degree to this effective manner of working is the fact that the screening plate 38 has such a large outer diameter that only a comparatively small gap $S_1$ occurs between the flywheel casing 3 and the outer periphery of the screening plate. The recess 55 is arranged at such a distance from the trigger coil 45 that it does not have any effect at all on the protective effect of the screening plate.

Through the described arrangement, the trigger coil 45 will always operate in the same, constant trigger magnetic field $P_5$, so that the trigger pulse $v_t$, FIG. 5, is generated at the desired moment of ignition predetermined by the adjustment lever 39, i.e. at time $t_1$. This favorable condition is prevalent independent of the engine speed and independent of the load put on the generator coils 31.

An alteration of the position of the adjusting arm 39 (possible adjusting angle ± 15°) constitutes an adjustment of the ignition timing, since the position for the trigger coil 45 will also then be altered. This adjustment capability meets the need for setting the ignition timing for different engine speeds.

The described embodiment for simplicity comprises only one trigger magnet 21, indicating a construction for one spark per revolution, i.e. a one-cylinder engine. However, two or more sparks per revolution can be effected by having two or more trigger magnets 21 arranged in the casing 3. The number of recesses 55 in the screening plate 38 must be suited to the number of trigger magnets, in which all the recesses 55 must be arranged at a distance from the trigger coil or coils 45 so that the protective effect of the screening plate 38 on the magnetic field from the trigger magnets is fully maintained.

I claim as my invention:

1. In an internal combustion engine having a crankcase and a flywheel casing, and having an electrical power generator system and an electronic ignition system both disposed under the flywheel casing, the combination comprising:

a. means mounting generating coils of the generator system and charging coils of the ignition system on said crankcase within said flywheel casing;

b. radially magnetized permanent magnet means common to both said generator and ignition systems and secured to said flywheel casing in surrounding relation to said generating coils and said charging coils for creating a rotating magnetic field therein:

c. a trigger coil carried on said crankcase and forming a part of said ignition system;

d. at least one trigger magnet, having radially going magnetic flux and axially displaced and carried on said flywheel casing, for said trigger coil creating a magnetic field therein axially separated from said permanent magnet generator field; and e. a shielding plate of ferromagnetic material nonrotatably carried by said crankcase and disposed between said generator permanent magnet field and said trigger magnet field, said shielding plate being arranged in a radial plane relatively to said flywheel casing.

2. In an internal combustion engine having a crankcase and a flywheel casing, and having an electrical power generator system and an electronic ignition system both disposed under the flywheel casing, the combination comprising:

a. means mounting generating coils of the generator system and charging coils of the ignition system on said crankcase within said flywheel casing;

b. permanent magnet means for both said generator and ignition systems and secured to said flywheel casing in surrounding relation to said generating coils and said charging coils for creating rotating magnetic fields therein;

c. a trigger coil carried on said crankcase and forming a part of said ignition system;

d. at least one trigger magnet carried on said flywheel casing for said trigger coil for creating a magnetic field therein; and e. a shielding plate of ferromagnetic material non-rotatably carried by said crankcase and disposed between said permanent magnet means and said trigger magnet, said shielding plate having an outer periphery proximate to the inside diameter of said flywheel casing, there being a peripheral recess in said plate for each said trigger magnet through which said trigger magnet can pass on assembling of the flywheel casing to the engine.

3. In an internal combustion engine having a crankcase and a flywheel casing, and having an electrical power generator system and an electronic ignition system both disposed under the flywheel casing, the combination comprising:

a. means mounting generating coils of the generator system and charging coils of the ignition system on said crankcase within said flywheel casing, mounting means including an armature plate secured to said crankcase and supporting said generating coils and said charging coils in a fixed position;

b. permanent magnet means for both said generator and ignition systems and secured to said flywheel casing in surrounding relation to said generating coils and said charging coils for creating rotating magnetic fields therein;

c. a trigger coil carried on said crankcase and forming a part of said ignition system;

d. at least one trigger magnet carried on said flywheel casing for said trigger coil for creating a magnetic field therein;

e. a shielding plate of ferromagnetic material non-rotatably carried by said crankcase and disposed between said permanent magnet means and said trigger magnet, said shielding plate supporting said trigger coil and being disposed on said armature plate concentric with said flywheel casing and adjustably angularly movable about the axis thereof; and f. means secured to said armature plate including a friction element for frictionally securing said shielding plate thereto in a selected angular position.

4. A combination according to claim 3 in which said securing means enables angular setting of the shielding plate within an included angle of at least 30°.

5. In an internal combustion engine having a crankcase and a flywheel casing, and having an electrical power generator system and an electronic ignition system both disposed under the flywheel casing, the combination comprising:

a. means mounting generating coils of the generator system and charging coils of the ignition system on said crankcase within said flywheel casing;

b. permanent magnet means for both said generator and ignition systems and secured to said flywheel casing in surrounding relation to said generating coils and said charging coils for creating rotating magnetic fields therein;

c. a trigger coil carried on said crankcase and forming a part of said ignition system;

d. at least one trigger magnet carried on said flywheel casing for said trigger coil for creating a magnetic field therein; and e. a shielding plate of ferromagnetic material non-rotatably carried by said crankcase and disposed between said permanent magnet means and said trigger magnet, said shielding plate supporting said trigger coil.

6. In an internal combustion engine having a crankcase and a flywheel casing, and having an electrical power generator system and an electronic ignition system both disposed under the flywheel casing, the combination comprising:

a. means mounting generating coils of the generator system and charging coils of the ignition system on said crankcase within said flywheel casing;

b. permanent magnet means for both said generator and ignition systems and secured to said flywheel casing in surrounding relation to said generating coils and said charging coils for creating rotating magnetic fields therein;

c. a trigger coil carried on said crankcase and forming a part of said ignition system;

d. at least one trigger magnet carried on said flywheel casing for said trigger coil for creating a magnetic field therein; and e. a shielding plate of ferromagnetic material non-rotatably carried by said crankcase and disposed between said permanent magnet means and said trigger magnet, a number of circuit components of at least one of said systems being encapsulated together as a single block supported by said shielding plate.

* * * * *